US007270747B2

(12) United States Patent
Happel et al.

(10) Patent No.: US 7,270,747 B2
(45) Date of Patent: Sep. 18, 2007

(54) STORM WATER DRAIN SYSTEM

(76) Inventors: Henry Happel, 140 Ruby St., Rockledge, FL (US) 32955; Thomas H. Happel, 5041 Scott Rd., Cocoa, FL (US) 32926

( * ) Notice: Subject to any disclaimer, the term of this patent is extended or adjusted under 35 U.S.C. 154(b) by 65 days.

(21) Appl. No.: 11/370,001

(22) Filed: Mar. 7, 2006

(65) Prior Publication Data

US 2006/0201860 A1 Sep. 14, 2006

Related U.S. Application Data

(60) Provisional application No. 60/661,650, filed on Mar. 11, 2005.

(51) Int. Cl.
*E03F 5/14* (2006.01)

(52) U.S. Cl. ..... 210/162; 210/163; 210/499

(58) Field of Classification Search ..... None
See application file for complete search history.

(56) References Cited

U.S. PATENT DOCUMENTS 232,948 A * 10/1880 Dernham ..... 210/318
587,559 A * 8/1897 Riley ..... 4/289
664,945 A * 1/1901 Guion ..... 4/652
809,201 A * 1/1906 Lutz ..... 210/314
2,182,795 A * 12/1939 Day ..... 210/164
2,615,526 A * 10/1952 Lane ..... 210/164
3,282,430 A * 11/1966 Kinne ..... 210/162
5,037,541 A * 8/1991 Ruey-Jang et al. ..... 210/141
5,069,781 A * 12/1991 Wilkes ..... 210/164
5,284,580 A * 2/1994 Shyh ..... 210/163
5,397,464 A * 3/1995 Hannon ..... 210/163
5,403,474 A * 4/1995 Emery ..... 210/163
5,405,539 A * 4/1995 Schneider ..... 210/747
5,480,254 A * 1/1996 Autry et al. ..... 404/2
5,486,287 A * 1/1996 Murphy et al. ..... 210/164
5,535,554 A * 7/1996 Harris Jr. ..... 52/12
5,562,819 A * 10/1996 Turner et al. ..... 210/85
5,632,889 A * 5/1997 Tharp ..... 210/165
5,643,445 A * 7/1997 Billias et al. ..... 210/162
5,810,510 A * 9/1998 Urriola ..... 405/45
5,820,762 A * 10/1998 Bamer et al. ..... 210/661
5,904,842 A * 5/1999 Billias et al. ..... 210/162
5,985,157 A * 11/1999 Leckner et al. ..... 210/747
6,106,707 A * 8/2000 Morris et al. ..... 210/163
6,178,565 B1 * 1/2001 Franco ..... 4/291
6,231,758 B1 * 5/2001 Morris et al. ..... 210/163
6,270,663 B1 * 8/2001 Happel ..... 210/163
6,287,459 B1 * 9/2001 Williamson ..... 210/99

(Continued)

*Primary Examiner*—Robert James Popovics
(74) *Attorney, Agent, or Firm*—William M. Hobby, III

(57) ABSTRACT

An in-line storm water drain system and a filter basket for a storm water drain system are provided in which the storm water drain system has a housing having an inlet and outlet thereinto and interior walls forming a plurality of chambers therein. The filter basket has a rigid frame and a plurality of screened sides and is attached to the interior walls. The filter basket has a pair of top screen filter doors and a pair of bottom screen filter doors to allow entry into the filter basket and on through to the bottom of the filter basket for cleaning the chambers. An inlet feed chute is attached to the filter basket open end and also has a screen bottom door and directs water from the housing inlet to and through the filter basket while collecting debris in the basket.

2 Claims, 2 Drawing Sheets

U.S. PATENT DOCUMENTS 6,379,541 B1 * 4/2002 Nicholas ..... 210/155
6,428,692 B2 8/2002 Happel
6,478,954 B1 * 11/2002 Turner et al. ..... 210/162
6,537,446 B1 * 3/2003 Sanguinetti ..... 210/163
6,562,233 B1 * 5/2003 Schilling et al. ..... 210/164
6,651,825 B2 * 11/2003 Turner et al. ..... 210/483
6,668,390 B1 * 12/2003 Gonzalez ..... 4/291
6,797,162 B2 * 9/2004 Happel ..... 210/163
6,824,677 B2 * 11/2004 Martinez ..... 210/97
6,866,153 B2 * 3/2005 Turner et al. ..... 210/483
6,872,029 B2 * 3/2005 Allard et al. ..... 405/36
6,979,148 B2 * 12/2005 Happel et al. ..... 405/43
7,112,274 B1 * 9/2006 Sanguinetti ..... 210/163
7,132,045 B1 * 11/2006 Trangsrud ..... 210/163
7,153,417 B2 * 12/2006 Happel ..... 210/122
2001/0047954 A1 * 12/2001 Happel ..... 210/155
2003/0132150 A1 * 7/2003 Happel ..... 210/163
2003/0136717 A1 * 7/2003 Tseng ..... 210/163
2003/0175079 A1 * 9/2003 Happel et al. ..... 405/46
2005/0069386 A1 * 3/2005 Happel et al. ..... 405/40
2005/0183997 A1 * 8/2005 Happel et al. ..... 210/163
2005/0218049 A1 * 10/2005 Happel ..... 210/163
2006/0163130 A1 * 7/2006 Happel et al. ..... 210/163
2006/0201860 A1 * 9/2006 Happel et al. ..... 210/162

* cited by examiner

STORM WATER DRAIN SYSTEM

This application claims the benefit of U.S. Provisional Application No. 60/661,650, filed Mar. 11, 2005.

BACKGROUND OF THE INVENTION

The present invention is a nutrient separating filter basket for a storm water drain system. A filter basket is installed within a storm water drain pipe system and receives storm water runoff therethrough and collects organic materials, such as grass clippings, leaves and tree stems, therein.

Drain water, which is frequently laden with trash, grass clippings, tree leaves and stems, sand, gravel, and other forms of sediment, is collected from streets, parking lots and other areas into a storm drain inlet where it is directed into a storm water drain pipe system. The drain water laden with trash, leaves, grass clippings, sand and gravel collected from the streets is fed through an entrance into a storm water catch basin and into a lake or retention pond. The retention pond can tolerate a certain amount of grass clippings and leaves collected from parking lots or along the street but debris left in the water for a long period of time decays and allows a buildup of soluable nutrients, such as nitrates and phosphates, to accumulate in the water. Thus, it is desirable to remove organic debris from the water collected from the drain water before it enters into lakes and retention ponds.

The present filter basket is added directly to the storm water drain pipe system for collecting trash, leaves, grass clippings, tree stems, and other organic matter in a manner to dry these materials before they can rot in the water and release soluable nutrients into the water. Sand, gravel, or other non-organic sediments can pass through the basket screen walls and collected within a drain water catch basin. The present system provides for an easily cleaned filter basket which allows rapid cleaning of the filter basket and filter box in situ.

In my prior U.S. Pat. No. 6,428,692 for an In-Line Storm Water Drain Filter System an in-line storm water drain filter and baffle box is installed within a storm water drain pipe to direct storm water runoff through the storm water drain pipe and through the filter and baffle box prior to the storm water drain water passing through an outfall into a lake, pond or retention area. This patent is for a filter system and includes a housing having an inlet and outlet and a plurality of chambers formed therein. The housing cover allows for access into a housing. A plurality of filter screens are mounted over each of the plurality of housing chambers for collecting trash from the storm water passing therethrough.

The present invention is an improvement to this prior U.S. patent and allows a screen filter basket to receive the inflow of storm water and to collect all of the larger debris while letting the water pass along with sand and grit to pass through the screen and into a baffle and settling box. A plurality of doors in the filter basket allow for the in situ cleaning of debris therefrom and from the settling box therebeneath.

SUMMARY OF THE INVENTION

The present invention is a storm water drain system having a nutrient separating filter basket installed within the storm water drain pipe system to receive storm water runoff therethrough and collect organic materials, such as grass clippings, leaves, and tree stems. The storm water drain system has a housing having an inlet thereinto and an outlet therefrom and having a plurality of interior walls, each having a top edge forming a plurality of open top chambers below the inlet. A filter basket having a rigid frame and a plurality of screen sides and a top and bottom and an open front end is attached to the interior wall edges. A pair of top screen filter doors cover most of the top for entry into the filter basket while a pair of bottom screen filter doors cover most of the bottom for entry into the chambers therebelow when the top screen filter doors are open. An inlet feed chute is attached to the filter basket open front end and is positioned in front of the storm water housing inlet for directing entering storm water into the filter basket. Water entering the housing inlet is directed by the inlet feed chute into the basket and through the screen sides and bottom while the filter basket is collecting the organic debris therein.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
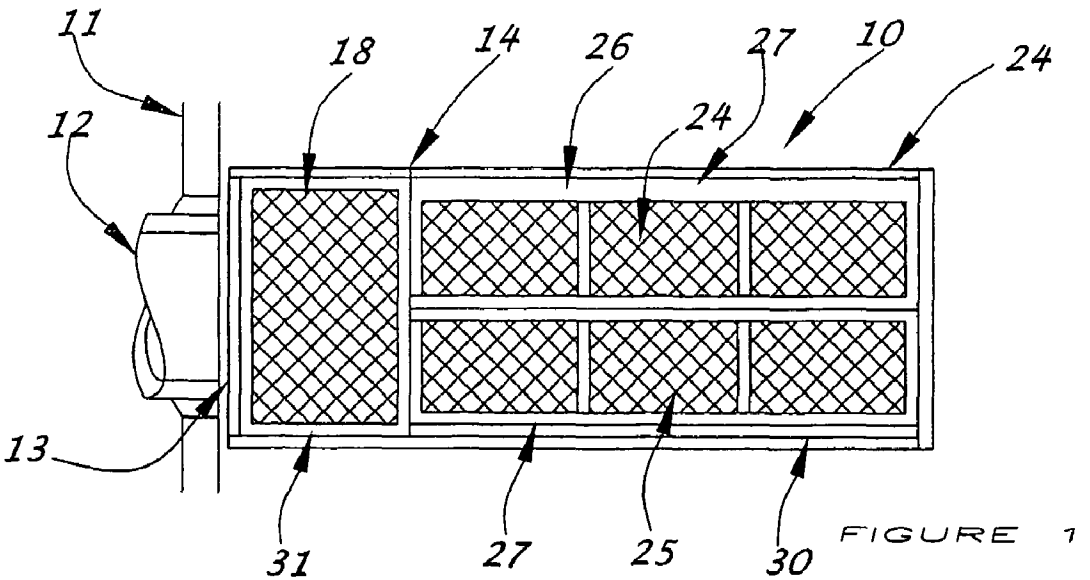
FIG. 1 is a top elevation of a filter basket mounted in the storm drain system.
Figure 2:
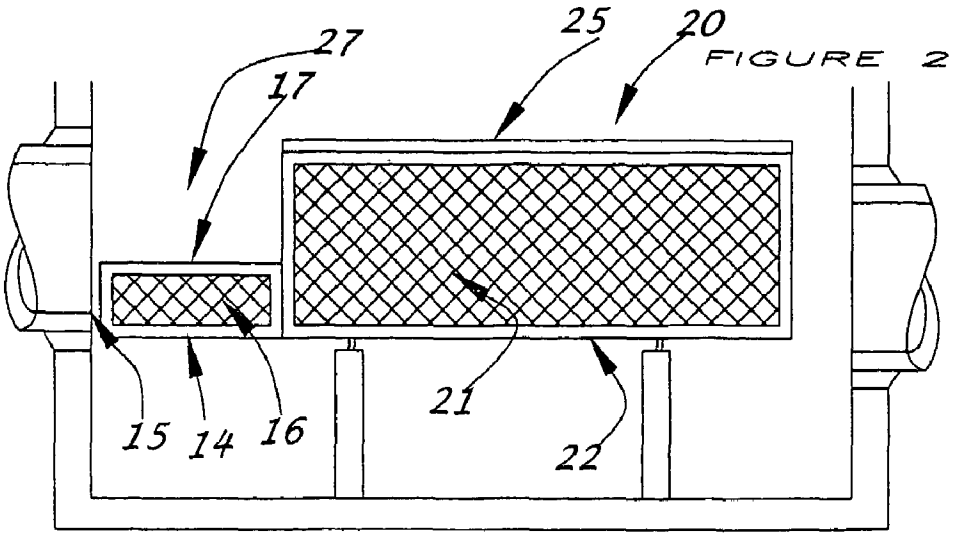
FIG. 2 is a side elevation of the filter basket of FIG. 1 in a storm drain system.
Figure 4:
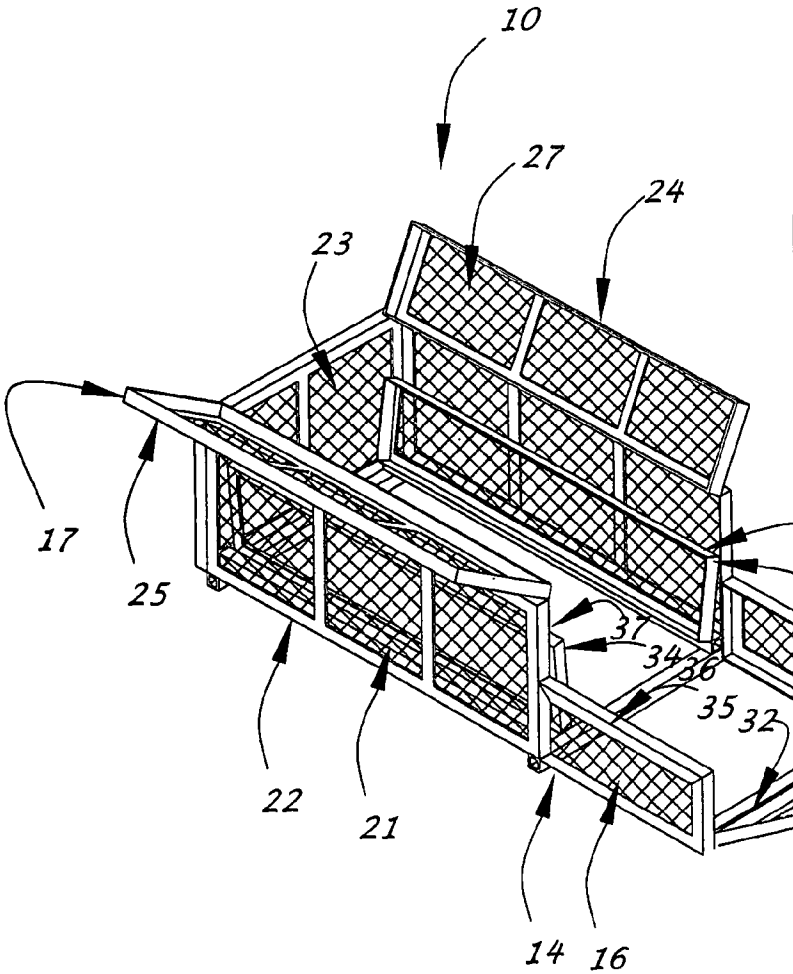
FIG. 4 is a perspective view of the filter basket of FIG. 3 having the hinged doors open.

Referring to the drawings and especially to FIGS. 1 and 2, a storm drain filter basket 10 is illustrated connected to a storm drain filter box 11 having an inlet 12 for the flow of storm drain water. The storm drain water enters the inlet 12 and passes into the front of the connected filter basket 10. Filter basket 10 has a second inlet section 13 which is connected so that the bottom 14 is adjacent the bottom 15 of the storm drain inlet 12 so that the inflowing storm drain water enters directly onto the basket section 13. Basket section 13 has a side screen 16 attached to a frame portion 17 and a bottom screen door 18. Thus, the incoming storm drain water can pass through the screen sides in 16 and bottom 18 while capturing trash, leaves, grass clippings, tree limbs, and allowing sand, gravel and other forms of sediment to pass through the screen 16 and 18 where it collects directly below the basket 10 into a sediment basin. The basket 10 has main basket portion 20 having side filter screens 21 attached to a rigid stainless steel framework 22. The basket also has a rear filter screen 23, as seen in FIG. 4. The top of the filter basket portion 20 consists of a pair of hinged screen doors 24 and 25 supported in a steel door framework 26 and 27, respectively. The door framework 24 is hinged at 28 while the door 25 is hinged at 30. In addition, the bottom filter screen door 18 has a framework 31 and is hinged at 32, as seen in FIG. 4.

Figure 3:
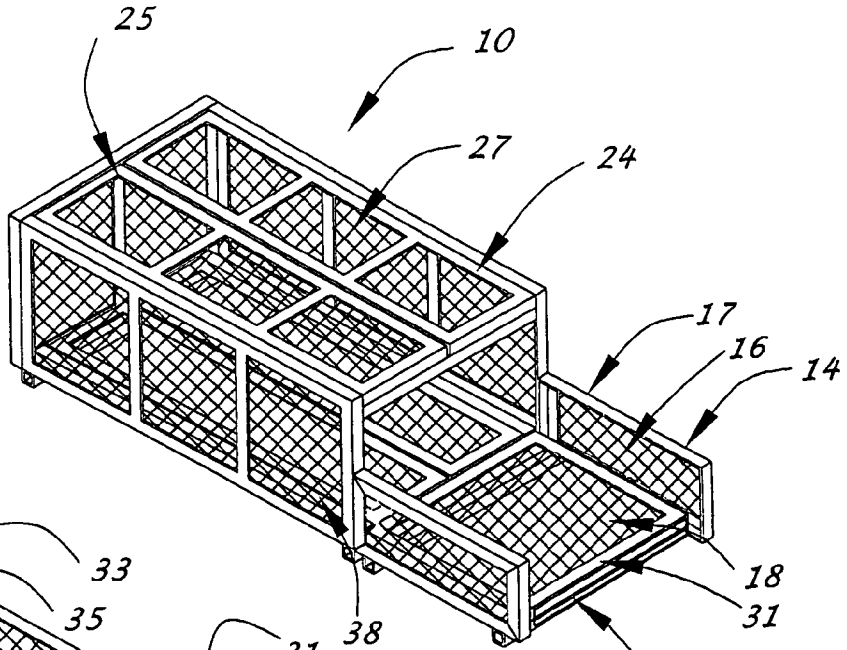
FIG. 3 is a perspective view of a filter basket in accordance with the present invention.

The screen door 18 can be in its normal closed position, as seen in FIG. 3, and can be rapidly opened, as seen in FIG. 4, while the filter basket 10 doors 24 and 25 can be swung from a closed position, as seen in FIGS. 1 and 3, to an open position, as seen in FIG. 4. The bottom of the filter basket portion 20 has a pair of screened filter doors 33 and 34 with the door 33 having the framework 35 and being hinged at 36 while the door 34 supports the screen in a frame 37 and is hinged at 38. The doors 33 and 34 can be maintained in a normal closed position, as seen in FIG. 3, and can be readily opened, as seen in FIG. 4. The filter basket advantageously collects trash, leaves, grass clippings, tree stems and the like from the incoming storm drain water while allowing the water to pass through the screens along with sand, gravel and other forms of sediment which can collect on the bottom of the filter box 11.

The filter basket 10 portion 20 can compact the entering debris therein and is prevented from being retained in the storm water for long periods of time where it would decay and allow the water to build up soluable nutrients, such as nitrates or phosphates. By removing the organic debris from the water before the drain water enters into lakes, retention ponds, or settling boxes, the build up of these soluable nutrients is prevented. Once the box is filled with organic debris, it can be easily cleaned in situ by opening the filter box 11 top openings, then opening the doors 24 and 25 and, using a vacuum hose, to rapidly remove all of the debris collected in the filter basket 10. Once the debris is removed, it is also necessary to remove the collected sediment, such as sand, gravel, and the like in the bottom of the filter system or filter box 11. This is done by opening the doors 31, 33 and 34, as seen in FIG. 4, while the doors 24 and 25 remain open to allow the filter hose from a vacuum truck to be inserted directly through the filter box 10 to remove all of the collected mostly non-organic debris, such as sand, gravel and the like, from the filter box.

It should be clear at this time that a storm drain filter basket has been provided which advantageously allows the rapid cleaning of the filter basket as well as the collected sediment from the bottom of a connected settling box or filter system. However, the present invention is not to be construed as limited to the forms shown which are to be considered illustrative rather than restrictive.

We claim:

1. An in-line storm water drain system comprising:

a housing having an inlet thereinto and an outlet therefrom and having a plurality of interior walls, each having a top edge, forming a plurality of open top chambers below said inlet;

a filter basket having a rigid frame and a plurality of screened sides and a top and bottom and an open front end, said filter basket rigid frame being attached to at least two of said interior wall edges;

a pair of side-by-side top screen filter doors covering at least a portion of said top for entry into said filter basket;

a pair of side-by-side bottom screen filter doors covering at least a portion of said bottom for entry into at least one of said plurality of chambers; and an inlet feed chute attached to said filter basket open front end, and having a pair of sides and a bottom having a screen door therein, said inlet feed chute being positioned in front of said storm water housing inlet for directing entering storm water into said filter basket, whereby an in-line storm water drain system filters materials from storm water passing through said storm water drain.

2. The in-line storm water drain system in accordance with claim 1 in which said plurality of interior walls each forms a baffle for water entering each said open top chamber.

* * * * *